US005532790A

United States Patent [19]

Akazawa

[11] Patent Number: 5,532,790

[45] Date of Patent: Jul. 2, 1996

[54] DEVICE FOR OPTICALLY DETECTING AN AMOUNT OF REMAINING DEVELOPER IN AN IMAGE FORMING APPARATUS

[75] Inventor: Takashi Akazawa, Toyokawa, Japan

[73] Assignee: Minolta Camera Kabushiki Kaisha, Osaka, Japan

[21] Appl. No.: 149,992

[22] Filed: Nov. 10, 1993

[30] Foreign Application Priority Data

| | | | |
|---|---|---|---|
| Nov. 13, 1992 | [JP] | Japan | 4-078318 U |
| Nov. 13, 1992 | [JP] | Japan | 4-078319 U |
| Nov. 13, 1992 | [JP] | Japan | 4-304201 |
| Nov. 13, 1992 | [JP] | Japan | 4-304202 |

[51] Int. Cl.[6] ..... G03G 21/00

[52] U.S. Cl. ..... 355/203; 118/694; 355/245

[58] Field of Search ..... 355/208, 246, 355/260, 245, 215, 298, 203–206; 118/691, 694; 340/617

[56] References Cited

U.S. PATENT DOCUMENTS

| | | | |
|---|---|---|---|
| 4,592,642 | 6/1986 | Imaizumi et al. | 355/205 |
| 4,891,675 | 1/1990 | Asanuma | 355/246 |
| 4,963,929 | 10/1990 | Ueda et al. | 355/215 |
| 4,980,727 | 12/1990 | Stelter | 355/208 X |
| 5,035,198 | 7/1991 | Niito | 355/208 X |
| 5,036,358 | 7/1991 | Yoshida | 355/245 X |
| 5,036,363 | 7/1991 | Iida et al. | 355/246 |
| 5,111,247 | 5/1992 | Nichols | 355/246 |
| 5,117,259 | 5/1992 | Etou et al. | 355/246 X |
| 5,166,732 | 11/1992 | Fuji | 355/245 |
| 5,187,522 | 2/1993 | Resch, III | 355/246 |
| 5,214,475 | 5/1993 | Ishii et al. | 355/246 |
| 5,216,469 | 6/1993 | Yamada | 355/246 |
| 5,237,372 | 8/1993 | Ishii et al. | 355/246 |
| 5,239,346 | 8/1993 | Corbin et al. | 355/260 |
| 5,276,481 | 1/1994 | Kinoshita et al. | 355/246 X |

FOREIGN PATENT DOCUMENTS 2-126273 5/1990 Japan .

*Primary Examiner*—Arthur T. Grimley
*Assistant Examiner*—Shuk Y. Lee
*Attorney, Agent, or Firm*—Willian Brinks Hofer Gilson & Lione

[57] ABSTRACT

A device for detecting the residual amount of a developer has a developer storing vessel, a light-emitting element for projecting a light for irradiation from the outside to the inside of the vessel, a light-receiving element disposed outside the vessel and adapted to receive the light for irradiation projected by the light-emitting element into the interior of the vessel and issuing a signal in response to the received light, and a control device for discerning between arrival and no arrival of the residual amount of the developer in the vessel at the prescribed level on the basis of the signal from the light-receiving element. The control device discerns the arrival of the residual amount of the developer in the vessel at the predetermined level when the state in which the duration of an excess of the output signal of the light-receiving element over the prescribed threshold level surpasses the first predetermined time interval repeats on a prescribed plurality of instances during the second predetermined time interval.

14 Claims, 10 Drawing Sheets

DEVICE FOR OPTICALLY DETECTING AN AMOUNT OF REMAINING DEVELOPER IN AN IMAGE FORMING APPARATUS

BACKGROUND OF THE INVENTION

1. Field of the Invention

This invention relates to a device for the detection of the residual supply of a developer, which device is incorporated in an image forming device utilizing an electrophotographic process and adapted to effect the detection of the residual amount of a developer.

2. Description of the Prior Art

As new additions to the class of such image forming devices as electrophotographic copying machines and laser beam printers which electrophotographically form a toner image on a recording paper, image forming devices of the type so adapted as to have an image forming cartridge disposed inside the main body of an image forming device for the sake of miniaturizing the image forming device are being developed. The image forming cartridge is otherwise called an image cartridge or an image forming unit and is so configured as to have a photosensitive drum incorporated inside a casing made of resin. The developer to be supplied to the photosensitive drum is stored in a hopper which is formed as a section of the interior of the casing. When the amount of the developer stored in the hopper has wholly run out or has become scarce, the image forming cartridge is replaced with a fresh supply.

For the purpose of detecting the fact that the residual amount of the developer stored in the image forming cartridge has run out or has become scarce, the image forming device has incorporated therein a device for detecting the residual amount of the developer (as disclosed in Japanese Patent Laid-Open No. 2-126,273, for example). This device for detecting the residual amount of the developer operates by the method of light transmission and, therefore, has two transmission windows formed in the image forming cartridge. A light-emitting element is set in place near one of the two transmission windows and a light-receiving element near the other transmission window. The light from the light-emitting element advances through the transmission window on the light-emitting element side, passes the interior of the image forming cartridge, advances through the transmission window on the light-receiving element side, and reaches the light-receiving element.

Some of the existing devices for detecting the residual amount of a developer operate by the method of reflection of light. In the device for detecting the residual amount of a developer by the method of light reflection, a transmission window is formed in an image forming cartridge and a reflecting plate is provided inside a hopper. A light-emitting element and a light-receiving element are disposed near the transmission window. The light from the light-emitting element is advanced through the transmission window, made to illuminate the interior of the hopper, reflected by the reflecting plate, advanced again through the transmission window, and allowed to reach the light-receiving element.

For the sake of convenience of explanation, the transmission window on the light-emitting element side used in the device of detection operating by the method of light transmission and the transmission window used in the device of detection operating by the method of light reflection will be collectively referred to as a light transmitting member for passing the light from the light-emitting element and allowing it to reach the interior of the image forming cartridge.

Likewise, the transmission window on the light-receiving element side in the device for detection operated by the method of light transmission and the reflecting plate in the device for detection operating by the method of light reflection will be collectively referred to as a light processing member for enabling the light projected inside the image-forming cartridge to reach the exterior of the image forming cartridge. Further, the light transmitting member and the light processing member will be collectively referred to as an optical member.

When the developer continues to adhere to the light transmitting member and the light processing member, the detection of the residual amount of the developer cannot be attained because the light path extending from the light-emitting element to the light-receiving element is blocked with the deposited developer. The device for detecting the residual amount of the developer, therefore, is provided with a cleaning member which is made of a flexible material such as a polyester film. This cleaning member sweeps the light transmitting member and the light processing member at a predetermined interval to deprive these members of the adhering developer.

While the residual amount of the developer in the image forming cartridge is amply large, the light-receiving element continues to assume an OFF state because the light path extending from the light-emitting element to the light-receiving element is blocked by the developer. When the developer is absent from the interior of the image forming cartridge, the light-receiving element assumes an ON state because the light from the light-emitting element is allowed to reach the light-receiving element. When the voltage level emitted from the light-receiving element is compared with the predetermined threshold level and found to surpass the threshold level, the device judges that the developer is running short and turns on a developer empty display to inform the operator of the fact that the residual amount of the developer has become scarce.

The conventional devices for detecting the residual amount of a developer which operate as described above have the following problems.

The developer stored in the hopper is agitated by a member having the shape of a vane and, therefore, the behavior of the developer in the fluid state inside the hopper is complicated. When the residual amount of the developer is judged to be running short simply because the voltage level of the light-receiving element has surpassed the threshold level, therefore, the residual amount of the developer which actually exists when the voltage level surpasses the threshold level is liable to vary from one image forming cartridge to another. This fact poses a problem of inconsistency of the accuracy for detecting the residual amount of a developer. Further, since the judgment that the residual amount of the developer has become small is formed when the voltage level of the light-receiving element surpasses the threshold level even once, the device is at a disadvantage in erroneously forming this judgment when the voltage level is compelled by the influence such as of noise to surpass the threshold level.

Besides the aforementioned cleaning member for cleaning the optical member, the device for detecting the residual amount of a developer is provided with a transporting member for stirring and transporting the developer inside the hopper and a drive member for driving the cleaning member and the transporting member. This drive member is formed of a rotary shaft which is rotationally driven by means of rotation transmitted thereto from a motor. This rotary shaft is set in place rotatably in the hopper. Like the cleaning member, the transporting member is generally made of a material having flexibility. The rotary shaft is provided with a supporting member disposed along the axial direction. The transporting member and the cleaning member are attached to this supporting member. In consequence of the rotation of the rotary shaft, the transporting member is deflected on account of the nature of its material and enabled to stir and convey the developer and the cleaning member is likewise deflected on account of the nature of its material and enabled to sweep the developer adhering to the light transmitting member and the light processing member. When the rotary shaft is rotated, the edge of the supporting member which elongates along the axial direction of the supporting member constitutes itself the point of force for imparting force to the flexible material.

Further, the practice of integrally forming the transporting member and the cleaning member by inserting cuts in one flexible material has been heretofore in vogue. The device for detecting the residual amount of a developer which has the transporting member and the cleaning member integrally formed with a flexible material as described above entails the following problems.

The aforementioned edge of the supporting member which functions as the point of force for imparting force to the flexible material is elongated in a planar form parallelly to the rotary shaft. To the transporting member and the cleaning member, therefore, the force of identical intensity will be transported. When the aforementioned edge of the supporting member is located at a position at which the transporting member is allowed to manifest the prescribed function of conveyance, the possibility arises that the cleaning member will fail to contact the light transmitting member and the light processing member strongly enough to obtain thorough removal of the developer adhering to these members. Particularly, since the detecting device which operates by the method of light reflection discriminates the shape of a reflecting plate, the position for fixation thereof, or the angle of fixation thereof on account of the construction of the device, it is liable to entail the possibility that the reflecting plate will escape being sufficiently cleaned. In this case, the idea of manufacturing a flexible material of large thickness into a transporting member and a cleaning member for the sake of enabling the cleaning member to manifest amply the function of cleaning may be conceived. When this idea is embodied, however, the disadvantage ensues that the noise which is produced when the transporting member in the process of stirring and transporting the developer is relieved of deflection becomes loud. When the flexible material is not given any change in thickness and the edge of the supporting member is located at a position at which the cleaning member is enabled to manifest the predetermined function of cleaning, however, the disadvantage arises that the load exerted by the developer on the transporting member unduly increases and the torque required in rotating the rotary shaft proportionately increases.

Further, in the conventional device for detecting the residual amount of a developer, a single cleaning member is used in sweeping the developer adhering to the light transmitting member and the light processing member. The detecting device which operates by the method of light reflection entails the possibility that when the cleaning member happens to part from the reflecting plate before it has completed sweeping the entire surface of the reflecting plate, the developer is left adhering in the form of lines on the reflecting plate and, as a result, the light from the light emitting element is not reflected by the reflecting plate even when the residual amount of the developer decreases below the prescribed level and the residual amount of the developer can no longer detected accurately. In the device of the conventional construction which utilizes a single cleaning member for the purpose of cleaning both the transmission window and the reflecting plate, therefore, the length of the cleaning member is set at a size which is enough for cleaning the entire surface of the transmission window and the entire surface of the reflecting plate. Likewise in the detecting device which operates by the method of light transmission, the length of the cleaning member is set at a size enough to sweep the entire surface of the transmission window on the light-emitting element side and the entire surface of the transmission window on the light-receiving element side.

When the light transmitting member and the light processing member are both cleaned by the use of a single cleaning member, the following problems are entailed.

In the detecting device which operates by the method of light reflection, since the light-emitting element and the light-receiving element are laid out on the transmission window side, the reflecting plate is restricted, for example, its shape, the position or the angle to be fixed inside the hopper. Further, as described above, the length of the cleaning member is set at a size which is enough for the purpose of cleaning the entire surface of the transmission window and the entire surface of the reflecting plate. Because of this length, the cleaning member possibly emits a harsh noise when it is advanced past the reflecting plate and is consequently relieved of deflection. The detecting device which operates by the method of light transmission allows certain freedom in deciding the shape of a pair of transmission windows, the positions for fixing them, and the angle of fixation thereof. Since the transmission windows are both cleaned by one and the same cleaning member after all, the possibility of the cleaning member likewise emitting a harsh noise arises, depending such as on the positions for fixing the transmission windows.

Since the developer barely adheres in the true sense of the word to the light processing member, feeble force suffices to sweep the adhering developer off the light processing member. In contrast, the developer piles up on the light transmitting member and, therefore, a fair amount of force is required to sweep the accumulated developer off the light transmitting member. When the cleaning member is made of a polyester film having a relatively large thickness for the purpose of enabling the developer on the light transmitting member to be infallibly swept off, the harsh noise which the cleaning member emits in the process of passing the light processing member unduly grows in volume because the light transmitting member and the light processing member are both cleaned with one and the same cleaning member. Conversely, when the cleaning member is made of a polyester film having a rather small thickness for the purpose of repressing the generation of the harsh noise, the possibility arises that the developer piled up on the light transmitting member will not be infallibly swept off and, as a result, the detection of the residual amount of the developer will not be made accurately.

SUMMARY OF THE INVENTION

This invention has been produced for the sake of relieving the aforementioned prior art technique of the inherent problems. The first object of this invention is to provide a device for detecting the residual amount of a developer, which device permits stabilization of the accuracy of the detection of the residual amount of the developer and allows accurate discernment of the arrival of the residual amount of the developer at the predetermined level.

The second object of this invention is to provide a device for detecting the residual amount of a developer, which device allows transporting means and cleaning means formed integrally of a flexible member respectively to manifest a prescribed function of transporting and cleaning.

The third object of this invention is to provide a device for detecting the residual amount of a developer, which device is provided with cleaning means capable of infallibly sweeping the developer adhering to a light transmitting member and a light processing member without entailing generation of harsh noise.

The fourth object of this invention is to provide a device for detecting the residual amount of a developer, which device is provided with cleaning means capable of cleaning a light transmitting member while radically preventing the generation of harsh noise during the passage of the light transmitting member over the light processing member.

This invention for fulfilling the first object described above is directed to a device for detecting the residual amount of a developer, which device comprises developer storing means for storing a developer therein, light emitting means disposed outside the developer storing means and adapted to emit a light and irradiate the interior of the storing means with the light, light receiving means for receiving the light emanating from the light emitting means disposed outside the developer storing means and impinging on the interior of the developer storing means and issuing a signal in response to the received light, and control means for discerning between arrival and no arrival of the residual amount of a developer stored in the developer storing means at a predetermined level on the basis of the signal from the light receiving member.

The control means discerns the arrival of the residual amount of the developer in the storing means at the prescribed level when the state in which the duration of an excess of the signal issued from the light receiving member over a predetermined threshold level surpasses a first prescribed time interval repeats on a predetermined plurality of instances during a second prescribed time interval.

This device for detecting the residual amount of a developer discerns between arrival and no arrival of the residual amount of the developer at the predetermined level on the basis of the duration in which the difference due to the residual amount of the developer appears conspicuously, namely the duration in which the signal from the light receiving means remains past the threshold level. Thus, the residual amount of the developer conforming to the prescribed threshold level is not suffered to fluctuate and the accuracy with which the residual amount of the developer is detected is stabilized. Further, the device discerns the arrival of the residual amount of the developer at the predetermined threshold level not when the state in which the duration of an excess of the signal issued from the light receiving member over a prescribed threshold level surpasses a first predetermined time interval just once but exclusively when the aforementioned state repeats on a prescribed plurality of instances. The device, therefore, is enabled to prevent the occurrence of erroneous detection under the influence such as of noise and discern accurately the arrival of the residual amount of the developer at the predetermined threshold level.

The device for detecting the residual amount of a developer further comprises a light transmitting member disposed in at least part of the developer storing means and adapted to pass the light emitted by the light emitting means in the direction of the interior of the developer storing means and a light processing member capable of enabling the light entering the interior of the developer storing means to reach the light receiving means. The cleaning means provided for the device for detecting the residual amount of a developer periodically cleans the light transmitting member and the light processing member to remove the developer adhering thereto.

This invention for fulfilling the second object described above is directed to a device for detecting the residual amount of a developer, which device comprises developer storing means for storing a developer therein, detecting means incorporated in the developer storing means, incorporating therein an optical member for passing or reflecting a light for irradiation, and adapted to detect the residual amount of the developer in the developer storing means by the use of the light, transporting means for stirring and transporting the developer stored in the storing means, cleaning means for cleaning the optical member for removal of the developer adhering thereto, the transporting means and the cleaning means being integrated, drive means for driving the transporting means and the cleaning means, first supporting means provided for the drive means and adapted to support the transporting means, and second supporting means provided for the drive means and adapted to support the cleaning means. The first supporting means and the second supporting means are integrated and these supporting means are furnished with different points for severally imparting force to the transporting means and the cleaning means. Further, the transporting means and the cleaning means are integrally formed of a flexible member.

In accordance with the device constructed as described above for detecting the residual amount of a developer, the first supporting means imparts force to the transporting means and the second supporting means imparts force to the cleaning means. Since different points are used for the impartation of force, the transporting means and the cleaning means are destined to receive forces different in magnitude. As a result, the transporting means is enabled to manifest infallibly the prescribed function of stirring and transporting the developer stored in the developer storing means without either receiving any undue load from the developer or generating any harsh noise. The cleaning means meanwhile manifests infallibly the predetermined function of sweeping the developer adhering to the optical member so as to ensure accurate detection of the residual amount of the developer.

This invention for fulfilling the third object described above is directed to a device for detecting the residual amount of a developer, which device comprises developer storing means adapted to store a developer therein and provided in at least part thereof with a light transmitting member, light emitting means disposed outside the developer storing means and adapted to project light for irradiation through the light transmitting member onto the interior of the developer storing means, light processing means for enabling the light entering the interior of the developer storing means to reach the exterior of the developer storing means, light receiving means disposed outside the developer storing means and adapted to receive the light from the light processing member and issue a signal in response to the received light, first cleaning means for cleaning the light transmitting member for removal of the developer adhering thereto, and second cleaning means for cleaning the light processing member for removal of the developer adhering thereto, the first and second cleaning means are disposed independently of each other. The first and second cleaning means are severally formed of a flexible member.

In accordance with the device constructed as described above for detecting the residual amount of a developer, since the light transmitting member and the light processing member are cleaned respectively by the first and second independent cleaning means during the detection of the residual amount of the developer, the thickness and length of the first cleaning means are easily adjusted to fit the purpose of sweeping the light transmitting member and the thickness and length of the second cleaning means are adjusted likewise to fit the purpose of sweeping the light processing member. As a consequence, the occurrence of harsh noise can be prevented and the developer adhering to the light transmitting member and the light processing member can be infallibly swept so as to ensure accurate detection of the residual amount of the developer.

This invention for fulfilling the fourth object described above is directed to a device for detecting the residual amount of a developer, which device comprises a light transmitting member, a light processing member, and cleaning means for cleaning the light transmitting member for removal of the developer adhering thereto, the cleaning means being so adapted as to avoid touching the light processing member.

In accordance with the device constructed as described above for detecting the residual amount of a developer, since the cleaning means sweeps the developer adhering to the light transmitting member without touching the light processing member during the detection of the residual amount of the developer, the possibility of the cleaning means being either deflected or deformed is nil and, as a result, the occurrence of harsh noise can be radically prevented. Further, the detection of the residual amount of the developer can be accurately performed because the cleaning means is no longer suffered to cause unintentional adhesion of the developer to the light processing member.

DETAILED DESCRIPTION OF THE PREFERRED EMBODIMENT

Now, one embodiment of this invention will be described below with reference to the accompanied drawings.

Figure 1:
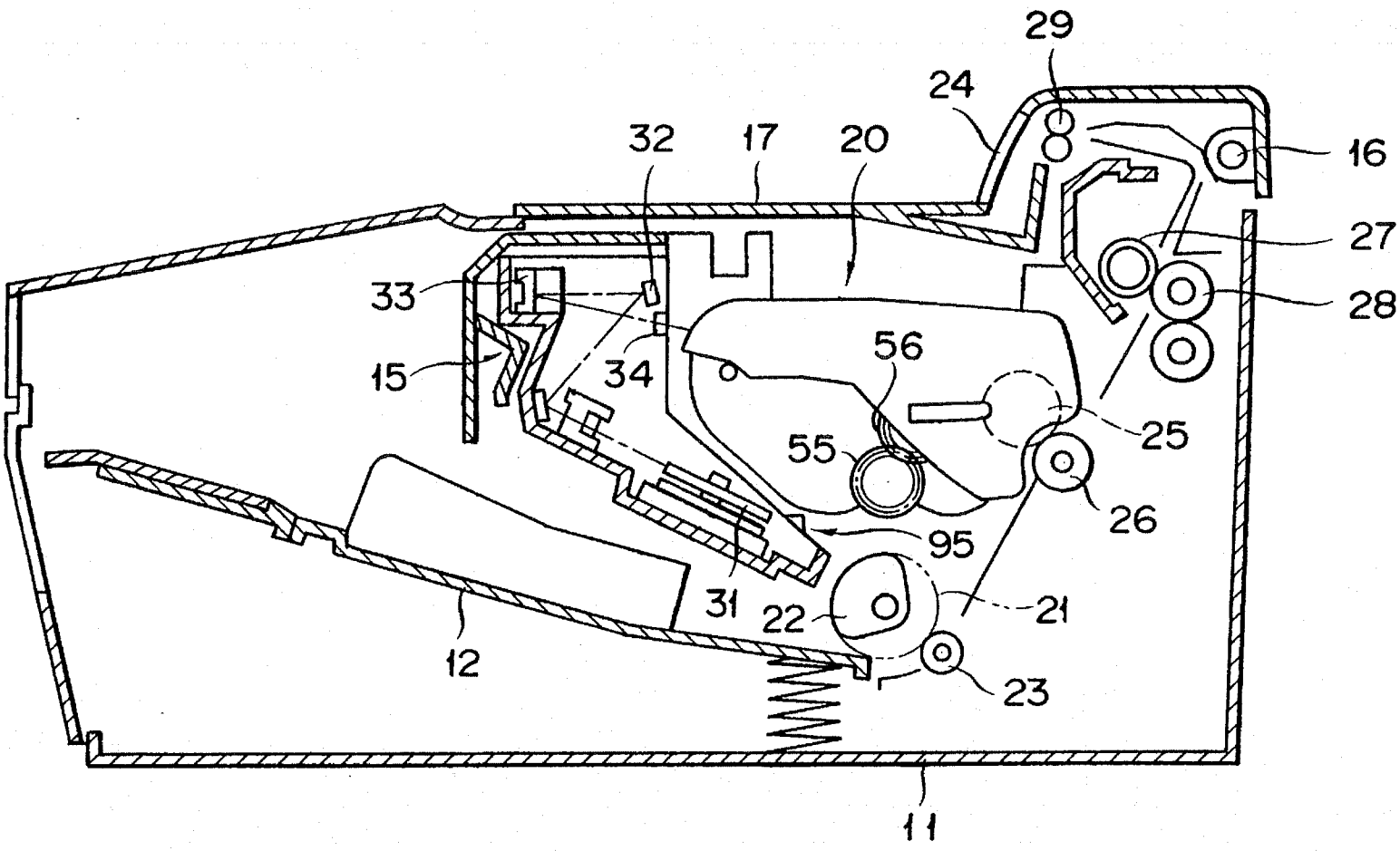
FIG. 1 is a schematic diagram illustrating the whole construction of a laser beam printer.

In a laser beam printer illustrated in FIG. 1, the left side in the bearings of the drawing of a frame 11 forming the main body of the device constitutes itself the front face of the printer. Recording papers are stored as piled on a sheet storing part 12 built in the bottom part of the frame 11. The frame 11 is provided in the central part thereof with a laser beam scanning optical unit 15. A lid member 17 is swingably attached to a hinge part 16 which is provided in the rear end part of the frame 11 and operated as a supporting point of the lid member 17. Inside the frame 11, an image forming cartridge 20 is detachably set in place as disposed below the lid member 17. A device 95 for detecting the residual amount of a developer (toner) is installed for the purpose of detecting the residual amount of the toner stored in the image forming cartridge 20.

The recording papers mounted on the sheet storing part 12 are fed out one by one by the joint action of a paper feeding roller 21, a cam 22, and a pinch roller 23 held in contact with the paper feeding roller 21 and the cam 22, transported as guided by guide members, and discharged through an outlet 24 formed in the lid member 17 onto the lid member 17 in the direction of the front side of the image forming device. In the image forming cartridge 20, a photosensitive drum 25 is rotatably incorporated and a transfer roller 26 for transferring a latent image formed on the photosensitive drum 25 onto the recording paper is rotatably attached to the frame 11. Fixing rollers 27 and 28 are attached to the frame 11 for the purpose of thermally fusing the transferred image to the recording paper. A paper discharging roller pair 29 is fixed inside the lid member 17 for the purpose of causing the recording paper having the image formed thereon to be discharged through the outlet 24 onto the lid member 17. The optical system unit 15 is provided with a polygon mirror 31 adapted to be irradiated with the light from a light source omitted from illustrating in the diagram and further provided with such well-known members as a turnaround mirror 32 and a toroidal mirror 33. The laser beam from the optical system unit 15 is passed through a glass 34 set in place in a window part and allowed to irradiate the photosensitive drum 25.

Figure 2:
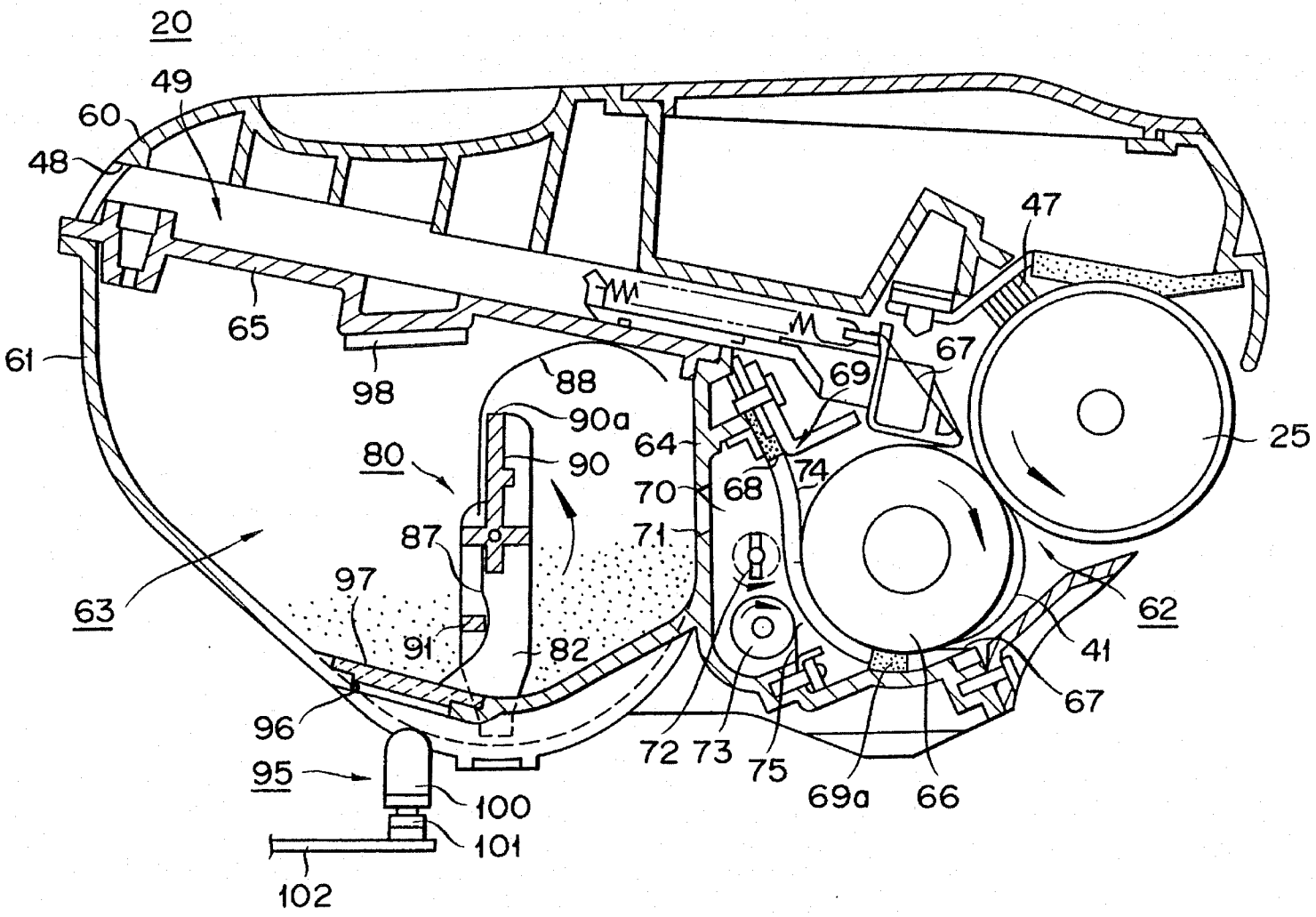
FIG. 2 is a cross section illustrating the internal construction of an image forming cartridge shown in FIG. 1 in conjunction with a device for detecting the residual amount of a developer.

FIG. 2 is a schematic cross section illustrating the image forming cartridge 20 in which the residual amount of the developer is detected by the device 95 for detecting the residual amount of the developer. The image forming cartridge 20 as a container capable of storing the developer is provided with a main body of cartridge which consists of an upper casing 60 and a lower casing 61. Inside this main body of cartridge, a developing member accommodating chamber 62 for accommodating the photosensitive drum 25 and a developer storing chamber 63 for storing therein the developer to be supplied to the developing member accommodating chamber 62 are disposed. The developer storing chamber 63 is designated as a hopper and defined inside the main body of cartridge by the lower casing 61, a partition wall 64 formed integrally with the lower casing 61, and a lid casing 65. In the leading end face of the upper casing 60 is formed an injection opening part 48 for allowing the injection of the laser beam from the optical system unit provided in the image forming device. A light path guiding part 49 extending from the injection opening part 48 to the photosensitive drum 25 is formed inside the main body of cartridge.

The developing member accommodating chamber 62 has the aforementioned photosensitive drum 25 incorporated rotatably therein. A charging brush 47 is held in contact with the outer circumferential surface of the photosensitive drum 25 and this charging brush 47 charges the outer circumferential surface to a predetermined potential. A developing sleeve 41 adapted to rotate by following the rotation of a drive roller 66 is so disposed as to adjoin the photosensitive drum 25. By a retaining tape 67, the developing sleeve 41 is slightly separated from the surface of the drive roller 66 at the position at which the developing sleeve 41 contacts the photosensitive drum 25 and allowed to contact the photosensitive drum 25 in a deflected state. An electrostatic latent image is formed by a laser beam on the surface of the photosensitive drum 25 and the developer which has been supplied via the developing sleeve 41 adheres to the electrostatic latent image and gives rise to a developer image on the surface of the photosensitive drum 25. This developer image is destined to be transferred onto the recording paper.

In the developing member accommodating chamber 62, a seal member 69 having a window part 68 formed therein and assuming the shape of a window frame is disposed along the axial direction of the drive roller 66. The seal member 69 is made of such material as polyurethane foam. A lower frame part **69*a* of the seal member 69 is interposed between the lower side of the drive roller 66 and the lower casing 61. This lower frame part 69*a* constitutes itself a lower seal serving the purpose of pressing the lower part of the developing sleeve 41 against the drive roller 66. To a buffer 70 which is an empty space intervening between the seal member 69 and the partition wall 64, the developer placed in the hopper 63 is delivered through a developer feeding inlet 71 formed in the partition wall 64. For the sake of supplying the developer in the buffer 63 to the developing sleeve 41, a vane member 72 assuming a planar shape and a supply roller 73 opposed to the vane member 72 across a prescribed gap are rotatably disposed inside the buffer 70. A regulating blade 74 adapted to regulate the amount of the developer to adhere to the developing sleeve 41 and, at the same time, triboelectrify the developer is held in contact with the developing sleeve 41 under a predetermined linear pressure. The reference numeral "75" used in the diagram denotes a scraper which is adapted to remain in sliding contact with the supply roller 73**.

Figure 3:
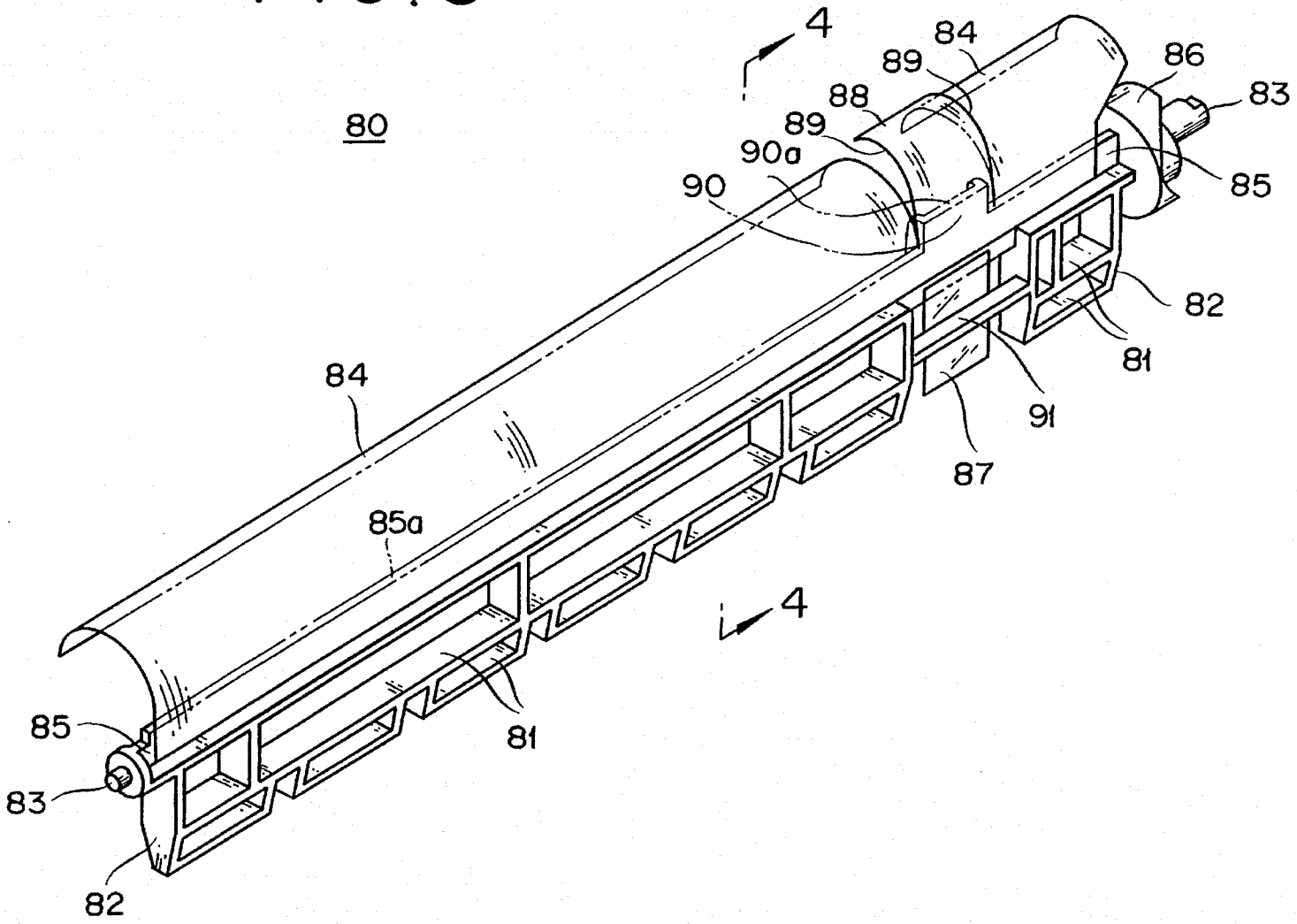
FIG. 3 is a perspective view illustrating a developer transporting device shown in FIG. 2.
Figure 4:
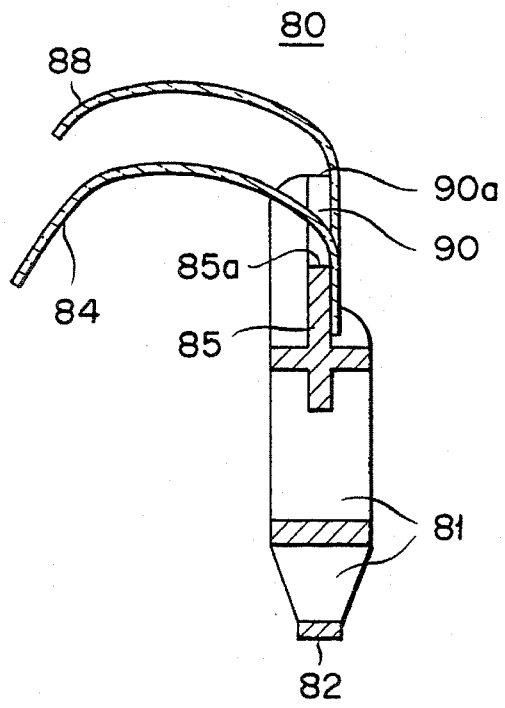
FIG. 4 is a cross section taken through FIG. 3 along the line 4—4.

In the developer storing chamber, namely the hopper 63, a developer conveyor 80 which stirs the developer placed in the hopper 63 and, at the same time, transporting the developer to the developer feeding inlet 71 is rotatably disposed. The developer conveyor 80, as illustrated in FIG. 3, is provided with a stirring member 82 which is furnished with an opening part 81 and adapted to stir the developer. This stirring member 82 is set in place along the axial direction of a rotary shaft (drive means) 83 and a transporting member 84 for stirring and transporting the developer is disposed axisymmetrically relative to the stirring member 82 along the axial direction thereof. The transporting member 84 is made of a flexible and permeable material such as a polyester film, with the basal end part thereof attached through the medium of an adhesive agent or a double-faced adhesive tape to a first supporting member 85 disposed along the axial direction thereof. At one end side of the rotary shaft 83 is provided a positioning member 86 for determining the position of the developer conveyor 80 in the axial direction thereof at the time that the developer conveyor 80 is attached to the hopper 63. In consequence of the rotation of the developer conveyor 80, the developer placed in the hopper 63 is stirred by the stirring member 82, stirred and conveyed by the transporting member 84, and passed through the developer feeding inlet 71 and delivered into the buffer 70.

A driving gear 55 is attached, as illustrated in FIG. 1, to the frame 11 as corresponded to the lateral surface of the image forming cartridge 20. This driving gear 55 is connected to a motor omitted from illustration in the diagram. For the purpose of transmitting the rotation of the driving gear 55 to the drive roller 66, the developer conveyor 80, the vane member 72, and the supply roller 73, a driven gear 56 is attached to the image forming cartridge 20 as partly exposed toward the lateral surface of the image forming cartridge 20. This driven gear 56 is connected through the medium of a train of gears omitted from illustration in the diagram such as to the drive roller 66 and the developer conveyor 80. By the rotation of the driving gear 55, the drive roller 66 and the developer conveyor 80 are driven rotationally. The photosensitive drum 25 is driven owing to the engagement between a gear formed integrally with the photosensitive drum 25 and omitted from illustration in the diagram, and a gear formed integrally with the transfer roller 26 and omitted from illustration in the diagram.

The image forming cartridge 20 constructed as described above is otherwise called an image cartridge, an image-forming unit or a process cartridge and is intended to be replaced with a new supply when the supply of the developer runs out. A laser beam printer which is furnished with the image forming cartridge 20, therefore, is provided with the device 95 for detecting the residual amount of the developer in the hopper 63. The detection of the residual amount of the developer is effected by either the method of light transmission or the method of light reflection. In the illustrated embodiment, the device 95 for detecting the residual amount of the developer by the method of light reflection is provided.

An aperture 96 is formed, as illustrated in FIG. 2, in part of the lower casing 61 which participates in defining the hopper 63. A transparent transmission window 97 made of acrylic resin, for example is fitted in the aperture 96. To the inner surface of the lid casing 65 opposed to the transmission window 97 is attached a reflecting plate 98 which has undergone a treatment for specular face. A light-emitting element 100 as light emitting means and a light-receiving element 101 as light receiving means are laid out in the proximity of the transmission window 97. The light-emitting element 100 is formed such as of a light-emitting diode and adapted to project a light for irradiation from outside the image forming cartridge 20 to the interior of the hopper 63. The light-receiving element 101 is formed such as of a phototransistor and adapted to receive the light for irradiation entering the interior of the hopper 63 outside the image forming cartridge 20 and issue a signal in response to the received light. The light emanating from the light-emitting element 100 passes through the transmission window 67 and reaches the reflecting plate 98 and the light reflected by the reflecting plate 98 again passes through the transmission window 97 and reaches the light-receiving element 101. The transmission window 97 functions as a light transmitting member for allowing passage of the light from the light-emitting element 100 and enabling the light to reach the interior of the image forming cartridge 20. The reflecting plate 98 functions as a light processing member for causing the light entering the interior of the image forming cartridge 20 to reach the exterior of the image forming cartridge 20.

Figure 7:
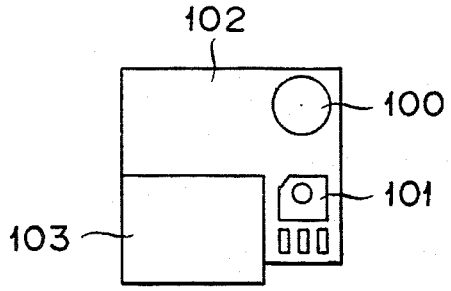
FIG. 7 is a plan view illustrating a substrate on which a light-emitting element and a light-receiving element are mounted.

The light-emitting element 100 and the light-receiving element 101, as illustrated also in FIG. 7, are fixed on one single substrate 102 so as to form the light path mentioned above. In the device for detecting the residual amount of a developer by the method of light transmission, the light-emitting element must be disposed on the lower side of the image forming cartridge 20 and the light-receiving element on the upper side of the image forming cartridge 20. In the device 95 for detecting the residual amount of a developer by the method of light reflection, the light-emitting element 100 and the light-receiving element 101 can be disposed at one place on the lower side of the image forming cartridge 20 as described above. Since just one place suffices to install a connector, therefore, the peripheral components of a harness and the like can be simplified and the cost of production can be lowered.

Figure 8:
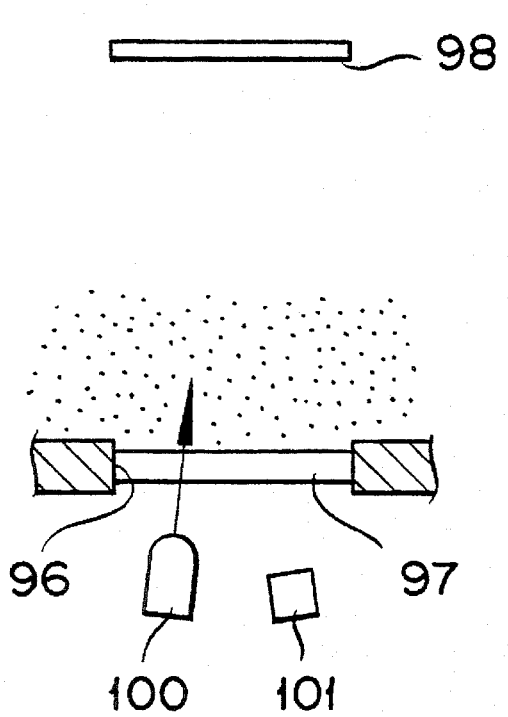
FIG. 8 is a conceptional illustration of the path for the light from the light-emitting element existing when the developer remains in an ample amount.
Figure 9:
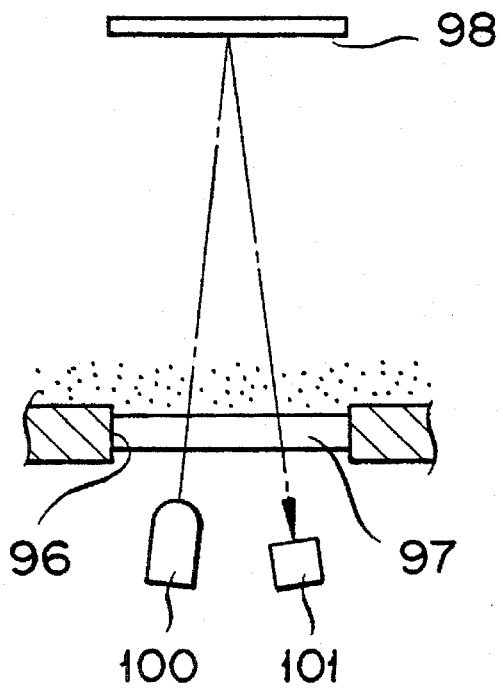
FIG. 9 is a conceptional illustration of the path of the light from the light-emitting element existing when the residual amount of the developer has become scarce.

FIG. 8 and FIG. 9 depict conceptional illustration of the path of light from the light-emitting element 100. When the residual amount of the developer in the hopper 63 is ample as illustrated in FIG. 8, the light from the light-emitting element 100 is intercepted by the heap of the developer and prevented from reaching the reflecting plate 98 and the light-receiving element 101 is caused to assume an OFF state. Conversely, when the residual amount of the developer becomes scarce as illustrated in FIG. 9, the light from the light-emitting element 100 passes through the transmission window 97 and reaches the reflecting plate 98 and then reflects on the reflecting plate 98, passes again through the transmission window 97, and reaches the light-receiving element 101, with the result that the light-receiving element will assume an ON state. The light-receiving element 101 issues a signal proportionate to the amount of the light to be received. On the basis of this signal, therefore, the device for detection discerns between arrival and no arrival of the residual amount of the developer in the hopper 63 at the predetermined level. The procedure for effecting this discernment will be specifically described hereinafter. Incidentally, the light-emitting element 100 continues to emit light so long as a main motor provided for the image forming device is kept in rotation.

The residual amount of the developer cannot be detected when the developer is constantly piled on the transmission window 97. When the developer adheres fast to the reflecting plate 98, the light is not reflected with consistency and, as a result, the residual amount of the developer cannot be detected with accuracy. As illustrated in FIG. 2 and FIG. 3, therefore, the developer conveyor 80 is provided with a transmission window sweeping member 87 for sweeping the developer piled on the transmission window 97 and a reflecting plate sweeping member 88 for sweeping the developer adhering to the reflecting plate 98. These sweeping members 87 and 88 are disposed separately. Hereinafter, the transmission window sweeping member 87 will be referred to as a first sweeping member and the reflecting plate sweeping member 88 as a second sweeping member.

The first sweeping member 87, as illustrated in FIG. 3, is disposed parallelly to the stirring member 82 between the separated sections of the stirring member 82. The first sweeping member 87 is made of a flexible and permeable material such as a polyester film, with the basal end part thereof fixed through the medium of an adhesive agent or a double-faced adhesive tape near the center of rotation of the developer conveyor 80.

Figure 5:
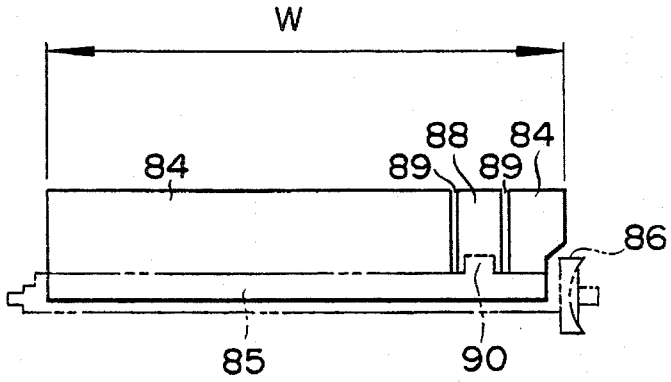
FIG. 5 is a diagram illustrating a flexible element of which a second cleaning member for sweeping a reflecting plate and a transporting member are integrally formed.

The second sweeping member 88, as illustrated also in FIG. 5, is integrally formed with the transporting member 84 by inserting two notches 89 in the polyester film which is the material of the transporting member 84. The width W of the polyester film along the axial direction thereof is substantially equal to the width of the interior of the hopper 63. This second sweeping member 88 is adapted so as to scrape off the developer stagnating on the wall side of the hopper 63. The right edge of the polyester film in the bearings of the diagram is partly cut off so that the second sweeping member 88 will be enabled to scrape off the developer on the wall side and, at the same time, avoid interfering with the axial direction positioning member 86.

Since the transmission window 97 and the reflecting plate 98 are cleaned respectively by the separate cleaning members 87 and 88, the thickness and length of the material of the cleaning members 87 and 88 can be easily varied. As specifically described hereinafter, therefore, the thickness and length of the material of the first cleaning member 87 can be selected so as to fit the work of cleaning the transmission window. Likewise, the thickness and length of the material of the second cleaning member 88 can be selected so as to fit the work of cleaning the reflecting plate 98.

Since the developer barely adheres in the true sense of the word to the upper side of the reflecting plate 98, a feeble force suffices to remove the developer by sweeping. As the material for the transporting member 84 and the second sweeping member, therefore, the polyester film having a thickness of about 100 microns is used. Since the developer piles up on the transmission window 97, the removal of the developer by sweeping necessitates a force of certain magnitude. The first sweeping member 87, therefore, is required to possess strong resistance. As the material for the first sweeping member 87, the polyester film having a larger thickness of about 188 microns than that of the material for the second sweeping member 88 is used. For the purpose of enabling the first sweeping member 87 to be pressed more strongly against the transmission window 97, the first sweeping member 87 is provided as illustrated in FIG. 2 and FIG. 3 at a position separated slightly outwardly in the radial direction from the center of rotation thereof with a keep plate 91 adapted to contact the rear surface side thereof.

Figure 6:
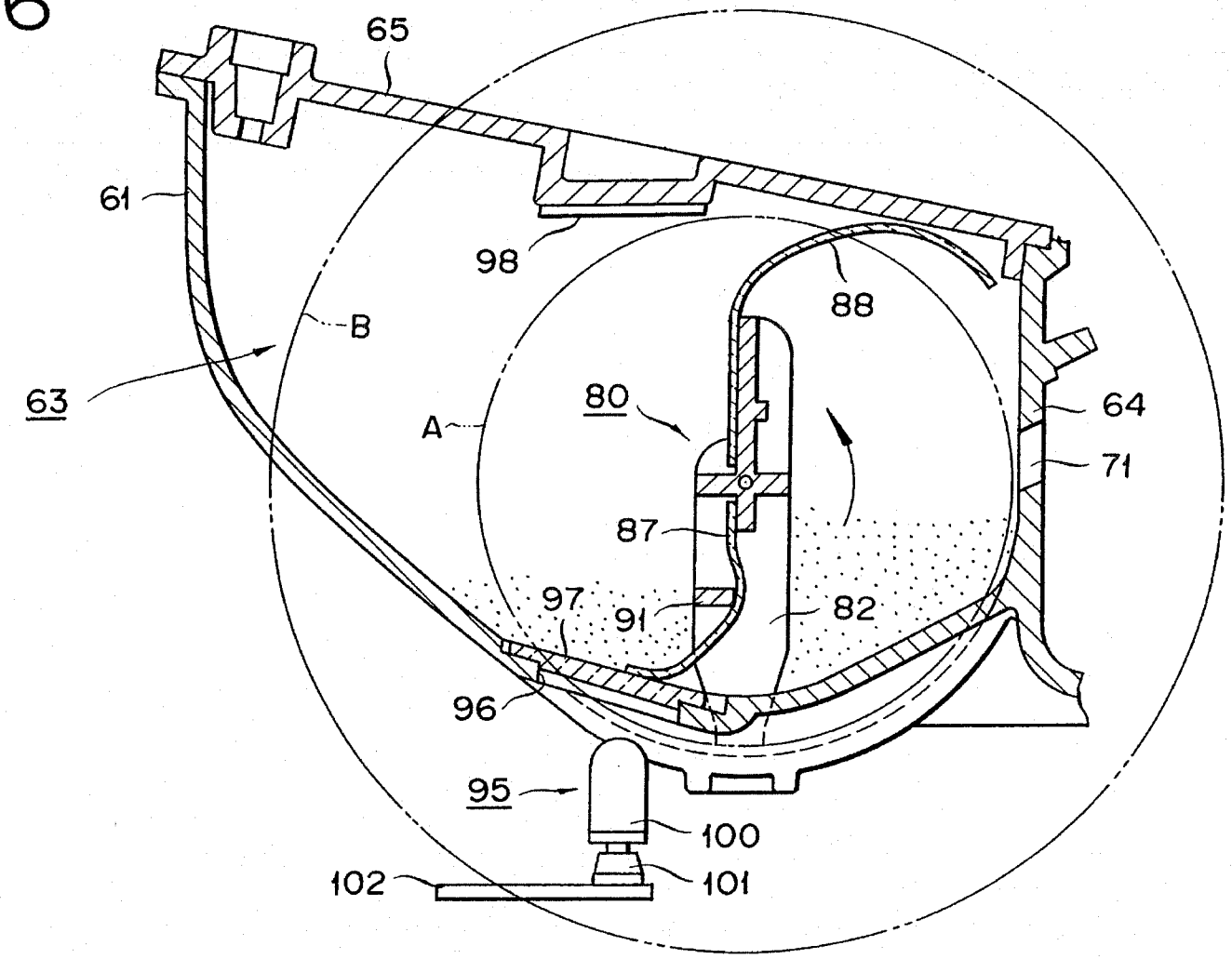
FIG. 6 is a magnified diagram of the essential part of FIG. 2 illustrating the range of reaches of the leading ends of the second cleaning member and a first cleaning member serving to clean transmission windows.

FIG. 6 clearly shows that the first and second sweeping members 87 and 88 are different in length; the circle A indicated by an imaginary line represents the maximum range of reach of the leading end of the first sweeping member 87 and the circle B indicated by an imaginary line represents the maximum range of reach of the leading end of the second sweeping member 88. As shown by these circles A and B, the first sweeping member 87 has a length enough to sweep the entire surface of the transmission window 97 and the second sweeping member 88 a length enough to sweep the entire surface of the reflecting plate 98. It is particularly noted from the circle A that the length of the first sweeping member 87 is such that this member 87 will never touch the reflecting plate 98.

The rotary shaft 83 is provided, as illustrated in FIG. 3, along the axial direction thereof with the first supporting member 85 adapted to support the transporting member 84. Further, a second supporting member 90 for supporting the second sweeping member 88 is disposed so as to protrude outwardly in the radial direction from an upper edge 85*a* of the first supporting member 85. The basal end part of the polyester film integrally forming the transporting member 84 and the second sweeping member 88 is attached through the medium of an adhesive agent or a double-faced adhesive tape to the first supporting member 85.

Figure 10:
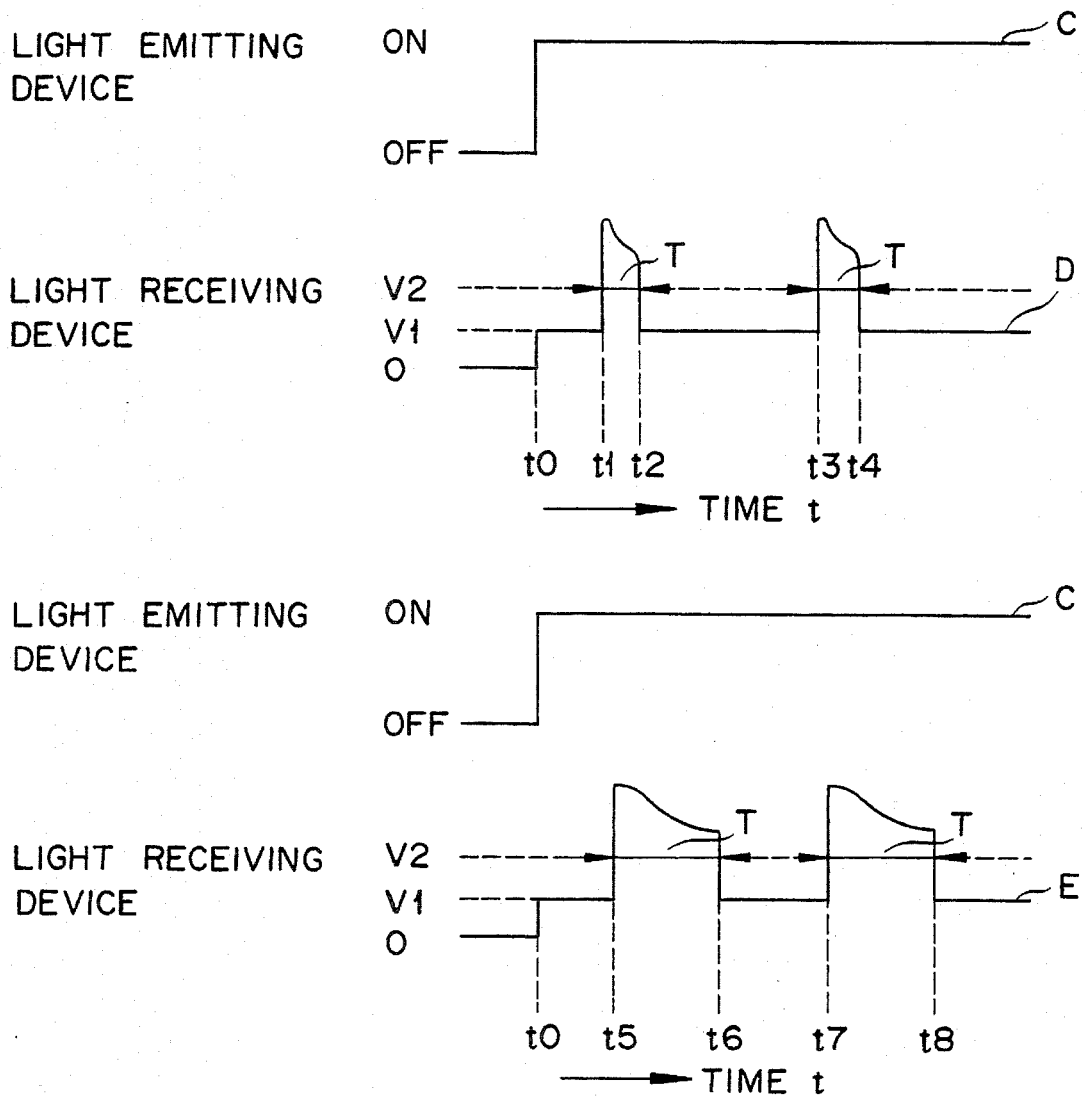
FIG. 10 shows timing charts of the ON and OFF states of the light-emitting element and the state of output voltage from the light-receiving element; Lines C and D being timing charts of the aforementioned states which exist when the residual amount of the developer surpasses the prescribed threshold level and Lines C and E being timing charts of the same states which exist when the residual amount of the developer has approximated the prescribed threshold level.

The light-receiving element 100, as shown by the line C in the timing chart of FIG. 10, assumes an ON state and starts emitting light at the time point t0. When the developer piled on the transmission window 97 is swept by the first sweeping member 87 in consequence of the rotation of the developer conveyor 80, the light from the light-emitting element 100 is reflected by the reflecting plate 98 and enabled to reach the light-receiving element 101 severally at the time points t1 and t5 as shown by the line D and the line E. The time cycles of the rotation of the developer conveyor 80 are represented by t1–t3 and t5–t7 in the diagram. The duration of these time cycles is about 2 sec. The light path from the light-emitting element 100 to the light-receiving element 101, during one complete rotation of the developer conveyor 80, is blocked by the developer conveyor 80 or blocked in consequence of the fact that the developer remaining in the hopper 63 again covers the transmission window 97. The output voltage of the light-receiving element 101, therefore, transforms to assume the pulse-like waveshape. Incidentally, part of the light emanating from the light-emitting element 100 is reflected on the surface of the transmission window 97 and reaches the light-receiving element 101. So long as the light-emitting element 100 continues to emit light, therefore, the light-receiving element 101 is constantly irradiated with the light, tough feebly, without reference to the residual amount of the developer. In the diagram, the output voltage V1 of the light-receiving element 101 represents the reference voltage, which is the output voltage of the light-receiving element 101 which exists when the light from the light-emitting element 100 is blocked inside the hopper 63. Further, in the diagram, V2 denotes the threshold value to be used during the detection of the pulse issued by the light-receiving element 101. This threshold value V2 has been set in advance.

When the residual amount of the developer placed in the hopper 98 happens to surpass the prescribed level (50 g, for example) as shown by the line D, the transmission window 97 is at once covered by the developer and the light path extending from the light-emitting element 100 through the light-receiving element 101 is immediately blocked. The duration in which the light-receiving element 101 continues to receive the light from the light-emitting element 100 or the duration of continuous transmission of light, therefore, is short and inevitably the durations T in which the output voltage of the light-receiving element 101 (hereinafter referred to as "light passage detecting durations T") become short as shown by t1–t2 and t3–t4. When the residual amount of the developer placed in the hopper 98 closely approximates the predetermined level as shown by the line E, the transmission window 97 is not covered at once by the developer and the light path extending from the light-emitting element 100 through the light-receiving element 101 is not immediately blocked. The duration in which the light-receiving element 101 continues to receive the light from the light-emitting element 100 is long and inevitably the light passage detecting durations T become long as shown by t5–t6 and t7–t8. The light passage detecting durations T which exist when the residual amount of the developer closely approximates the prescribed level are about 100 m.sec. each.

The duration of light passage during which the light-receiving element 101 continues to receive the light from the light-emitting element 100 and the light passage detecting durations T during which the output voltage of the light-receiving element 101 surpasses the threshold level V2 both show conspicuous differences before and after the residual amount of the developer closely approximates the predetermined level.

Figure 11:
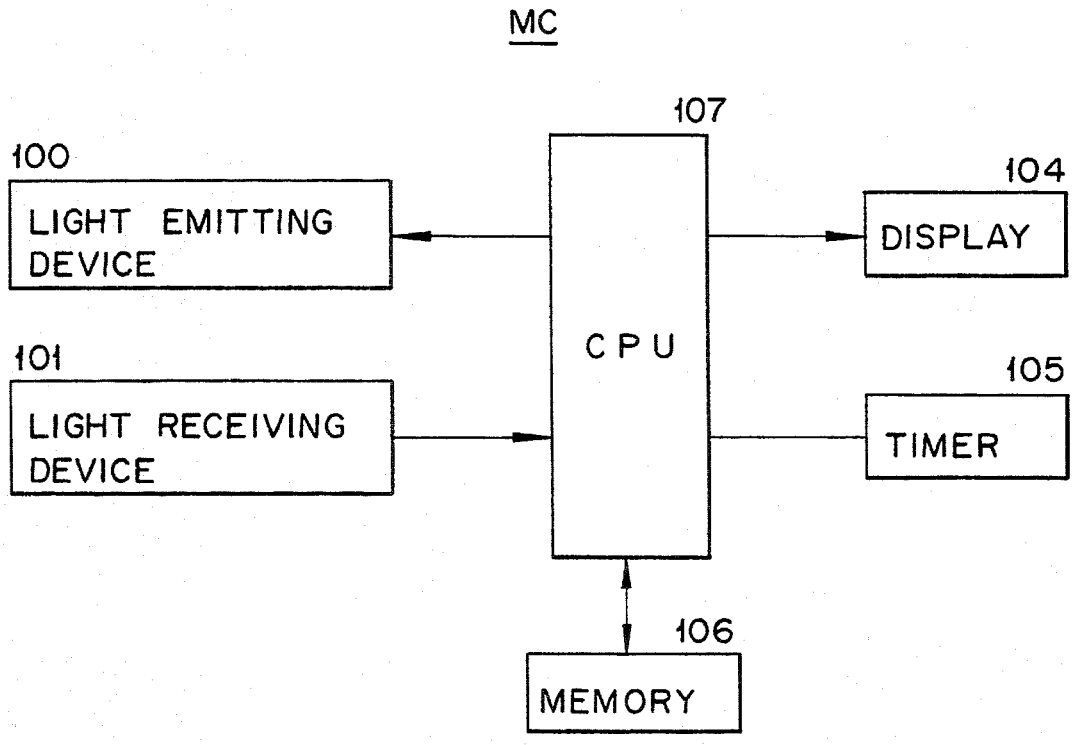
FIG. 11 is a block diagram illustrating control means.

FIG. 11 is a schematic block diagram illustrating a control system for detecting the residual amount of the developer. To a CPU 107 formed of a microcomputer (MC) and intended as control means, the light-emitting element 100 and the light-receiving element 101 are connected through the medium of inlet and outlet ports which are omitted from illustration in the diagram. The CPU 107 issues a control signal for driving the light-emitting element 100. An analog signal which the light-receiving element 101 issues in response to the received light is converted by an A/D converter not shown in the diagram into a digital signal and the digital signal is input into the CPU 107. Further, a display part 104 which turns on an LED, for example, by way of informing the operator of the fact that the residual supply of the developer is running short, is connected to the CPU 107. Besides, a timer 105 for clocking the elapsing time and memory means 106 such as ROM or RAM are connected to the CPU 107.

Further, the control means MC of the present embodiment, with due regard to the fact that the elongation of the light passage detecting durations T manifests itself conspicuously past the time at which the residual amount of the developer closely approximates the prescribed level, judges whether or not the residual amount of the developer in the hopper 63 has reached the predetermined level on the basis of the signal from the light-receiving element 101 as follows. The control means MC discerns the arrival of the residual amount of the developer in the hopper 63 at the prescribed level when the state in which the light passage detecting duration T indicative of the presence of an excess of the output voltage of the light-receiving element 101 over the predetermined threshold level V2 surpasses a first prescribed time interval repeats on a predetermined plurality of instances during a second prescribed time interval which is longer than the first predetermined time interval mentioned above.

To be more specific, the control means MC first measures the light passage detecting time T during the time intervals (t1–t3 and t5–t7 in FIG. 10) of rotation of the developer conveyor 80. This measurement is accomplished by the fact that the timer 105 clocks the interval between when the output voltage of the light-receiving element 101 rises above the threshold value V2 and when the output voltage falls below the threshold value. Then, the control means CM discerns the arrival of the residual amount of the developer in the hopper 63 at the prescribed level (50 g, for example) when the state in which the light passage detecting time T found by the measurement surpasses the predetermined time interval such as 100 m.sec continues to exist while the developer conveyor 80 produces five complete rotations. In the present embodiment, therefore, the "first prescribed time interval" is 100 m.sec., the "second predetermined time interval" is 10 sec. which suffices for five complete rotations of the developer conveyor 80, and the "prescribed plurality of instances" is 5. Incidentally, the first cleaning member 87 of the developer conveyor 80 is destined to clean the transmission window 97 on a predetermined number of instances while the developer image is being formed on one recording paper. It is recommended to adopt a number not exceeding the number of instances just mentioned as the "prescribed plurality of instances" mentioned above.

Now, the procedure for the detection of the residual amount of the developer will be described below based on the flow chart shown in FIG. 12 and the schematic time shown in FIG. 13. The pulse of the light-receiving element 101 shown in FIG. 13 represents the pulse which exists when the light passage detecting duration T exceeding 100 m.sec. which represents the first predetermined time interval.

Figure 12:
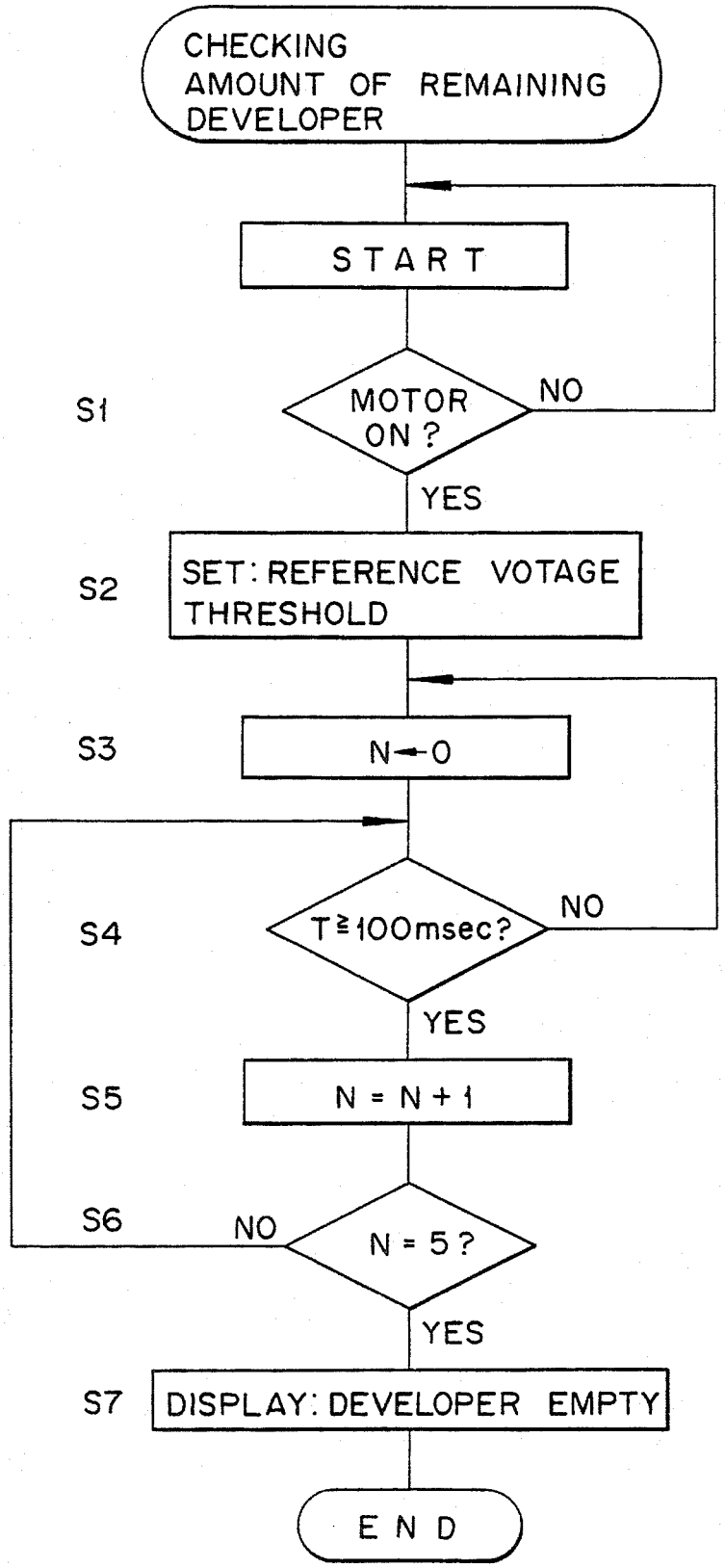
FIG. 12 is a flow chart illustrating a processing for checking the residual amount of the developer.
Figure 13:
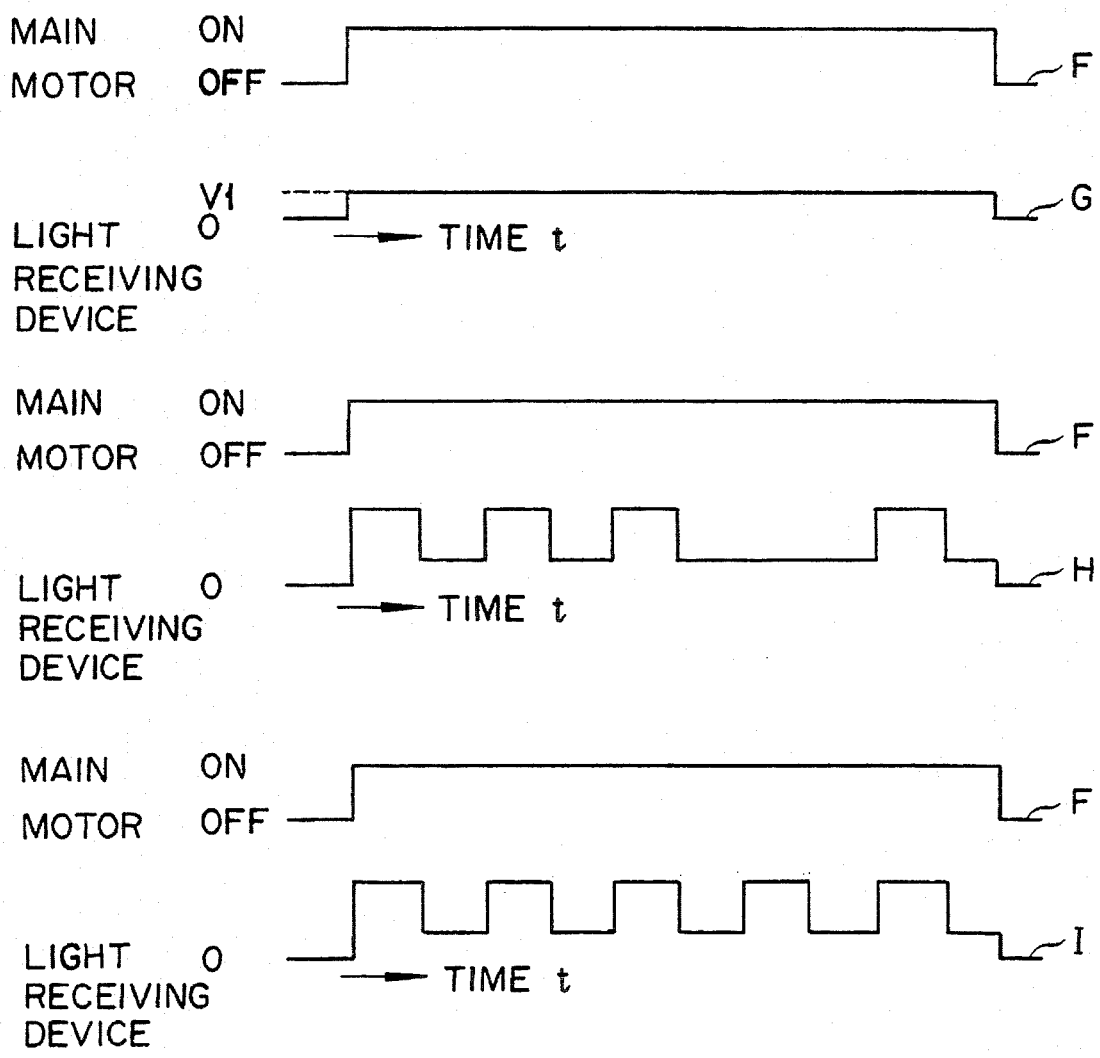
FIG. 13 is schematic time charts of the ON and OFF states of the main motor and the state of output voltage from the light receiving device.

When the main motor provided for the image forming device is turned on to set the image forming device operating in Step S1 as shown in FIG. 12, the light-emitting element 100 is turned on to start emitting light and set a reference voltage V1 and the threshold level V2 (S2) as shown by the line F in FIG. 13. Then, it resets a variable N for memorizing the fact that the light passage detecting duration T found by measurement is in a state of surpassing the prescribed time interval of 100 m.sec (S3). The timer 105 and similar components are set to the initial states.

At the Step S4, the light passage detecting duration T in which the output voltage of the light-receiving element 101 continues to exceed the threshold level V2 during the time interval (about 2 seconds) of rotation of the developer conveyor 80 is measured by the timer 105. The timer 105 judges whether the light passage detecting duration T found by the measurement exceeds 100 m.sec. In the initial stage of the operation of the detecting device in which the supply of the developer in the hopper 63 is ample, the transmission window 97 continues to be covered with the developer and the light path extending from the light-emitting element 100 through the light-receiving element 101 is kept blocked even when the first cleaning member 87 sweeps the developer piled on the transmission window 97 in consequence of the rotation of the developer conveyor 80. As a result, the output voltage of the light-receiving element 101 continues to be equal to the reference voltage V1 as shown by the line G in FIG. 13. In this case, the operation returns to the Step S3 to reset the variable N and then repeat the steps S3 and S4.

When the amount of the developer in the hopper 63 decreases to a point where the light from the light-emitting element 100 is reflected by the reflecting plate 98 and allowed to reach the light-receiving element 101, the control means MC detects the pulse issued from the light-receiving element 101. When the residual amount of the developer is greater than the predetermined level, however, the transmission window 97 is covered at once by the developer and the light path extending from the light-emitting element 100 through the light-receiving element 101 is immediately block. As a result, the duration in which the light continues to pass or the width of the pulse is decreased and the light passage detecting duration T is also decreased to below 100 m.sec. At this time, the decision at the Step S4 falls on NO again, with the result that the operation returns to the Step S3 to reset the variable N and then repeat the Steps S3 and 4.

When the developer in the hopper 63 is further consumed and the residual amount of the developer closely approximates the prescribed level, the transmission window 97 is not covered at once by the developer and the light path extending from the light-emitting element 100 through the light-receiving element 101 is not immediately blocked. As a result, the pulse width is increased and the light passage detecting duration T is increased to above 100 m.sec. At this time, the variable N is given an increment of 1 (S5).

At the step S6, the numerical value of the variable N is used as the basis for judging whether the state in which the light passage detecting duration T found by measurement surpasses 100 m.sec. has continuously repeated on five instances. If the number of repetitions falls short of 5, the processing at the steps 4 to S6 is repeated.

The line H in FIG. 13 represents the situation in which the excess of the light passage detecting duration T found by measurement over 100 m.sec. has continuously repeated while the developer conveyor 80 has made three complete rotations but the light passage detecting duration T has failed to exceed 100 m.sec. on the fourth rotation of the developer conveyor 80. In this case, the decision of the Step S4 falls on NO and the operation returns to the Step S3 and the variable N given an increment thence is repeat. Thereafter, the processing of the Steps S4 to S6 is repeated anew.

The line I in FIG. 13 represents the case in which the light passage detecting duration T exceeding 100 m.sec. has been measured continuously on five instances while the developer conveyor 80 has produced five complete rotations. In this case, the control means MC for the first time discerns the arrival of the residual amount of the developer at the predetermined level (S6). It then turns on the LED in the display part 104 by way of informing the operator of the fact that the supply of the developer has run out. Thus, the series of processing for checking the residual amount of the developer is completed.

As described above, the device 95 of the present embodiment for detecting the residual amount of the developer, with due regard to the fact that the light passage detecting durations T in which the output voltage of the light-receiving element 101 surpasses the threshold level V2 is conspicuously elongated past the time at which the residual amount of the developer closely approximates the prescribed levels discerns the close approximation of the residual amount of the developer to the predetermined level when the light passage detecting duration T increases above the time interval (for example 100 m.sec.) set in advance. Since the discernment between arrival and no arrival of the residual amount of the developer at the proximity to the prescribed level is based on the light passage detecting duration T whose difference is conspicuously manifested proportionately to the residual amount of the developer, the residual amount of the developer subject to the detection is not suffered to fluctuate and the accuracy with which the residual amount of the developer is detected can be retained substantially consistently even when the behavior of the developer as to the condition of stirring is more or less varied between the image forming cartridges 20.

Further, the fact that the supply of the developer has run out is discerned only after the close approximation of the residual amount of the developer to the predetermined level has been continuously counted on five instances while the developer conveyor 80 has produced five complete rotations. Even if the close approximation of the residual amount of the developer to the prescribed level is erroneously counted just once under the influence such as of noise, therefore, this one count does not result in detection of the exhaustion of the developer supply. Thus, the erroneous detection can be prevented and the arrival of the residual amount of the developer at the predetermined level can be exactly discerned.

Now, the conveyance of the developer and the cleaning of the optical members 97 and 98 will be described below.

When the rotary shaft 83 of the developer conveyor 80 is driven rotationally at a prescribed time interval, the first cleaning member 87 deflects while sweeping the developer piled on the transmission window 97, the second cleaning member 88 deflects while sweeping the developer adhering to the reflecting plate 98, and the transporting member 84 deflects while stirring and conveying the developer while succumbing to deflection by reason of material.

When the rotary shaft 83 is rotated, the edge 85*a* of the first supporting member 85 while is elongated along the axial direction thereof constitutes itself the point of force for imparting force to the transporting member 84 and the edge 90*a* of the second supporting member 90 which is elongated along the axial direction thereof constitutes itself the point of force for imparting force to the second cleaning member 88. The edge 90*a* of the second supporting member 90 is positioned outwardly in the radial direction from the edge 85*a* of the first supporting member 85. The distance from the point of force of the second cleaning member 88 to the reflecting plate 98 is relatively short and even the polyester film possessing flexibility is consequently enabled to produce strong contact with the reflecting plate 98. As a result, the developer adhering to the reflecting plate 98 is thoroughly cleaned and the second cleaning member 88 is enabled to manifest the predetermined function fully. Further, since the distance from the point of force of the transporting member 84 to the inner wall of the hopper 63 is infallibly secured, the load exerted by the developer on the transporting member 84 is kept from increasing and the torque required for rotating the rotary shaft 83 is not suffered to increase.

Since the transporting member 84 can be enabled to manifest the prescribed function of transporting and the second cleaning member 88 similarly to manifest the predetermined function of cleaning simply by suitably altering the points of force mentioned above, the transporting member 84 and the second cleaning member 88 are no longer required to be formed of the polyester film having a thickness larger than is required in itself. When the transporting member 84 stirs and transports the developer, therefore, the possibility of this member 84 emitting a large noise during the relief of deflection is nil.

Further, since the transporting member 84 and the second cleaning member 88 can be integrally formed of one and the same flexible material and the transporting member 84 and the second cleaning member 88 can be severally vested with different magnitudes of force, the cost of production of these members can be lowered.

In the present embodiment, the first cleaning member 87 and the second cleaning member 88 are disposed separately, the first cleaning member 87 is made of a material whose thickness and length are selected to meet the purpose of cleaning the transmission window 97, and the second cleaning member 88 is made of a material whose thickness and length are selected to meet the purpose of cleaning the reflecting plate 98. As a result, the harsh noise which would be produced if the transmission window 97 and the reflecting plate 98 were cleaned by the use of one and the same member is not produced. Besides, the developer can be swept infallibly and the detection of the residual amount of the developer can be detected exactly.

The first cleaning member 87 which is made of a material having a relatively large thickness, as shown by the circle A in FIG. 6, is adapted so as to avoid touching the reflecting plate 98 when the developer conveyor 80 is rotated. As a result, the polyester film which is the material of the first cleaning member 87 cannot touch the reflecting plate 98 and consequently deflect in the process of passing over the reflecting plate 98. Thus, the possibility of the first cleaning member 87 generating harsh noise on being relieved of deflection is radically eliminated.

Moreover, since the first cleaning member 87 is incapable of touching the reflecting plate 98, the possibility that the first cleaning member 87 will contact the reflecting plate 98 and depart from the reflecting plate 98 before it has completely swept the entire surface of the reflecting plate 98 is radically eliminated. The developer, therefore, cannot continue to adhere linearly to the reflecting plate 98. Since the light from the light-emitting element 100 is infallibly reflected by the reflecting plate 98 when the residual amount of the developer has decreased below the prescribed level, the detection of the residual amount of the developer can be attained exactly.

The embodiment cited above has been described as discerning the arrival of the residual amount of the developer at the predetermined level when the excess of the light passage detecting duration T over 100 m.sec. has continuously occurred on five instances. The present invention is not limited to this particular condition. For example, the arrival of the residual amount of the developer at the predetermined level may be discerned on the condition not that the state of an excess of the light passage detecting duration T over the prescribed level fails to occur continuously but that the number of occurrences of the state mentioned above totals the prescribed plurality during the second time interval. Further, the first time interval, the second time interval, and the predetermined plurality of instances are not limited to those used in the embodiment cited above but may be suitably selected.

The developer conveyor 80 has been portrayed as having the first and second supporting members 85 and 90 formed integrally of a resin material. Optionally, the second supporting member 90 may be formed separately of the first supporting member 85 and attached to the first supporting member 85 in such a manner as to protrude outwardly in the radial direction from the upper edge 85*a* thereof. The preceding embodiment has been depicted as having the transporting member 84 integrated with the second cleaning means 88 for cleaning the light processing member 98. Optionally, the first cleaning means 87 for cleaning the light transmitting member 97 may be integrated with the transporting member 84. It is further permissible to have the stirring member 82 and the first cleaning member 87 integrally formed of one and the same flexible material and also have these members 82 and 87 vested with different magnitudes of force by suitably altering the positions of the edges of the supporting members serving the purpose of severally supporting these members 82 and 87.

The device 95 for detecting the residual amount of the developer by the method of light reflection has been pictorially cited above. This invention can be applied to a device for detecting the residual amount of a developer by the method of light transmission. In this case, the light processing member which enables the light for irradiation reaching the interior of the hopper 63 to reach the exterior of the image forming cartridge 20 corresponds to the transmission window on the light-receiving element side provided such as for the lid casing 65. Even in the detecting device operating by the method of light transmission similarly to that which has been described thus far, since the two transmission windows are severally cleaned by the separate cleaning members 87 and 88, the thickness and length of the material fit for cleaning the transmission window on the light-emitting element side can be selected and the thickness and length of the material fit for cleaning the transmission window on the light-receiving element side can be selected. Further, the fact that the first cleaning member 87 is incapable of touching the transmission window on the light-receiving element side radically eliminates the possible generation of harsh noise, prevents the developer from continuing to adhere linearly to the transmission window on the light-receiving element side, and allows the accurate detection of the residual amount of the developer.

The vessel which is capable of storing the developer and, at the same time, incorporating the developer conveyor 80 therein is not limited to the image forming cartridge 20 and the image forming device for incorporating therein the device 95 for detecting the residual amount of the developer is not limited to the laser beam printer.

I claim:

1. A device for detecting an amount of remaining developer comprising:

developer storing means for storing developer therein;

light emitting means for emitting light from an outside to an inside of said developer storing means;

light receiving means provided outside said developer storing means for receiving the light emitted to the inside of said developer storing means by said light emitting means and outputting signals corresponding to the received light;

first detecting means for detecting a condition that a time interval during which the signal outputted by said light receiving means exceeds a predetermined threshold value is longer than a first time; and second detecting means for detecting that said condition detected by said first detecting means occurs a predetermined number of times during a second time that is longer than said first time.

2. The device as claimed in claim 1 further comprising a light transmitting member on at least a part of said developer storing means through which light is emitted to the inside of said developer storing means by said light emitting means, and a light processing member for making the emitted light reach said light receiving means.

3. The device as claimed in claim 2 further comprising cleaning means for cleaning developer adhered to said light transmitting member and said light processing member.

4. The device as claimed in claim 3, wherein said cleaning means cleans the developer periodically.

5. A device for detecting an amount of remaining developer comprising:

developer storing means for storing developer therein;

detecting means for detecting an amount of developer remaining in said developer storing means by using light, said detecting means including an optical member incorporated in said developer storing means for passing or reflecting a light for irradiation;

transporting means for stirring and transporting the developer stored in said storing means;

cleaning means for cleaning developer adhered to or piled on said optical means, wherein said transporting means and said cleaning means are integrated as a unit;

driving means for driving said transporting means and said cleaning means;

first supporting means provided on said driving means for supporting said transporting means; and second supporting means provided on said driving means for supporting said cleaning means.

6. The device as claimed in claim 5, wherein said first and second supporting means are integrated as a unit, and each of them has a different point for applying force to said transporting means or cleaning means respectively.

7. The device as claimed in claim 5, wherein said transporting means and said cleaning means are made of flexible material.

8. A device for detecting an amount of remaining developer comprising:

developer storing means for storing developer therein;

a fight transmitting member provided on at least a part of said developer storing means;

light emitting means for emitting light from an outside to an inside of said developer storing means through said light transmitting member;

a light processing member for making the light emitted to the inside of said developer storing means reach the outside of said developer storing means;

light receiving means provided outside said developer storing means for receiving the light from said light processing member and outputting signals corresponding to received light;

a first cleaning member for cleaning developer adhered to or piled on said light transmitting member; and a second cleaning member for cleaning developer adhered to or piled on said light processing member, said second cleaning member having a length different from said first cleaning member.

9. The device claimed in claim 8, wherein the thickness of said first cleaning member is different from that of said second cleaning member.

10. The device claimed in claim 8, wherein said first and second cleaning members are made of flexible material.

11. The device claimed in claim 8, wherein said first cleaning member does not contact said light processing member.

12. A device for detecting an amount of remaining developer comprising:

developer storing means for storing developer therein comprising a light transmitting member on at least a part thereof;

light emitting means for emitting light from an outside to an inside of said developer storing means through said light transmitting member;

light processing member for making the light emitted to the inside of said developer storing means reach the outside of said developer storing means;

light receiving means provided outside said developer storing means for receiving the light from said light processing member and outputting signals corresponding to received light; and cleaning means for cleaning developer adhered to or piled on said light transmitting member, and said cleaning means untouching said light processing member.

13. The device as claimed in claim 12, wherein said cleaning means is made of flexible material.

14. The device as claimed in claim 12 further comprising second cleaning means for cleaning developer adhered to said light processing member.

* * * * *